US006790077B1

(12) United States Patent
Chen

(10) Patent No.: US 6,790,077 B1
(45) Date of Patent: Sep. 14, 2004

(54) IEEE-1394 ADAPTER

(75) Inventor: Ching-Jou Chen, Taipei (TW)

(73) Assignee: Tatung Co., Ltd, Taipei (TW)

( * ) Notice: Subject to any disclaimer, the term of this patent is extended or adjusted under 35 U.S.C. 154(b) by 7 days.

(21) Appl. No.: 10/417,261

(22) Filed: Apr. 17, 2003

(51) Int. Cl.[7] ..... H01R 11/00
(52) U.S. Cl. ..... 439/502; 439/638
(58) Field of Search ..... 439/502, 638, 439/623

(56) References Cited

U.S. PATENT DOCUMENTS 5,593,317 A * 1/1997 Humbles ..... 439/502
5,984,717 A * 11/1999 Lee ..... 439/501
6,280,243 B1 * 8/2001 Liu et al. ..... 439/502
6,283,789 B1 * 9/2001 Tsai ..... 439/502
6,439,923 B1 * 8/2002 Kirkendall et al. ..... 439/502
6,498,890 B1 * 12/2002 Kimminau ..... 385/134
6,530,085 B1 * 3/2003 Perlman ..... 725/82

* cited by examiner

*Primary Examiner*—Gary Paumen
(74) *Attorney, Agent, or Firm*—Bacon & Thomas PLLC

(57) ABSTRACT

An IEEE-1394 adapter comprises a four pin female port including a signal end; a six pin male port including a signal connecting end and a power connecting end; a first connecting wire for connecting the signal end of the four pin female port with the signal connecting end of the six pin male port; a power plug being a DC power plug and having a power end; the power plug including a male connecting end and a female connecting end; and a second connecting wire for connecting the power end of the power plug with the power connecting end of the six pin male port. Therefore the IEEE-1394 adapter has the functions of converting a mini-type four pin port to be as a standard six pin port and integrating with the power supply. The application is convenient and the peripheral device is expandable.

4 Claims, 3 Drawing Sheets

IEEE-1394 ADAPTER

FIELD OF THE INVNETION

The present invention relates to an IEEE-1394 adapter, and particularly to an IEEE-1394 adapter for converting a four pin port into a six pin port, wherein by the function of converting the four pin port to a six pin port and the power supply function, the application is convenient and the peripheral device is expandable.

BACKGROUND OF THE INVENTION

In general, due to the confinement of the volume of a portable computer device, only four pin IEEE-1394 port (mini type) is used instead of standard six pin IEEE-1394 adapter. To improve this defect, currently, the adapter for converting four pin IEEE-1394 adapter into six pin IEEE-1394 adapter is developed.

However above said adapter for converting four pin IEEE-1394 adapter into six pin IEEE-1394 adapter has no power supply, and thus peripherals, such as optic disk drive, digital camera, of standard six pin IEEE-1394 adapter can not be used. Currently, nonstandard power connector is provided, but this will increase the space and weight of the mainframe. Moreover, power consumption of battery will increase and thus heat is generated so that the use thereof is inconvenient. Moreover, it can not be expanded with external peripheral devices.

SUMMARY OF THE INVENTION

Accordingly, the primary object of the present invention is to provide an IEEE-1394 adapter, by the function of converting the four pin port to a standard six pin port and the power supply function, the application is convenient and the peripheral device is expandable.

To achieve the object of the present invention, the present invention provides an IEEE-1394 adapter which comprises a four pin; female port including a signal end; a six pin male port including a signal connecting end and a power connecting end; a first connecting wire for connecting the signal end of the four pin female port with the signal connecting end of the six pin male port; a power plug being a DC power plug and having a power end; the power plug including a male connecting end and a female connecting end; and a second connecting wire for connecting the power end of the power plug with the power connecting end of the six pin male port.

Therefore the IEEE-1394 adapter of the present invention has the functions of converting a mini-type four pin port to be as a standard six pin port and integrating with the power supply. Therefore by the function of converting the four pin port to a six pin port and the power supply function, the application is convenient and the peripheral device is expandable.

The four pin female port is correspondingly connected to a four pin male port of a portable computing device, and the male connecting end of the power plug is correspondingly connected to a power seat of the portable computing device.

The six pin male port is correspondingly connected to a six pin female port of a computer peripheral device. The female connecting end of the power plug is correspondingly connected to a power supply male connecting end of the power supply plug of a power supply.

The various objects and advantages of the present invention will be more readily understood from the following detailed description when read in conjunction with the appended drawing.

BRIEF DESCRIPTION OF THE PREFERRED EMBODIMENTS

Figure 1:
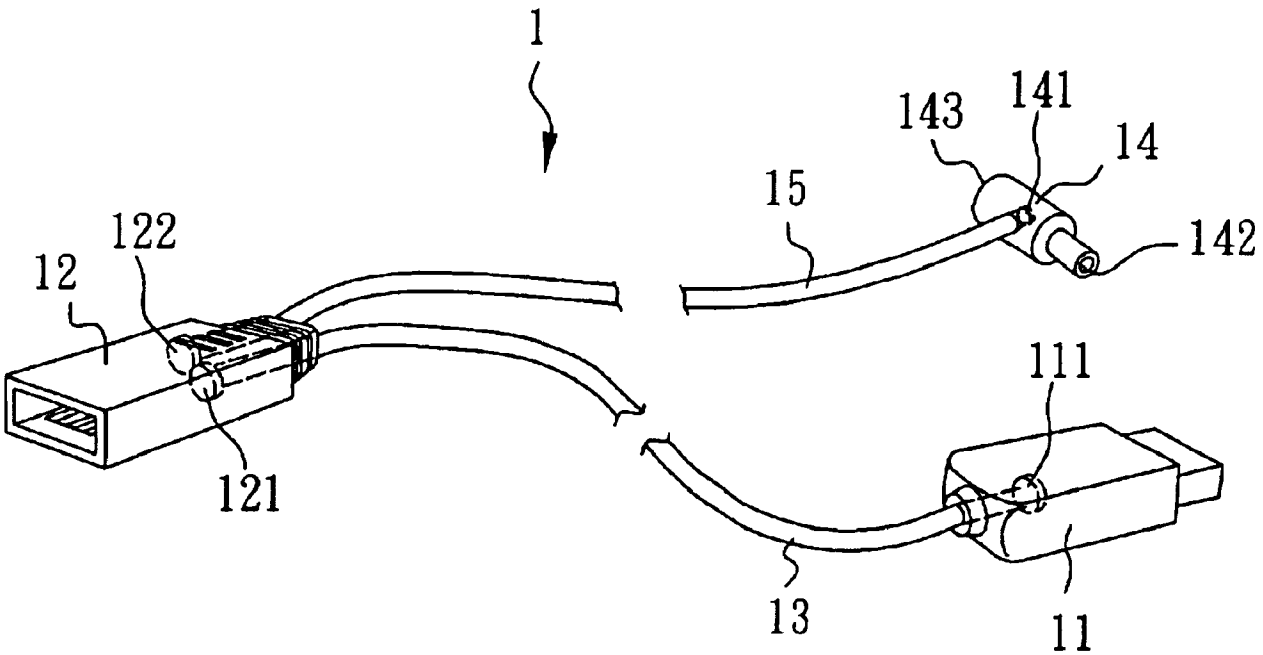
FIG. 1 is a perspective view of the present invention.

Referring to FIG. 1, a perspective view of the present invention is illustrated. In the drawing, an IEEE-1394 adapter 1 is illustrated. The IEEE-1394 adapter 1 mainly includes a four pin female port 11, a six pin male port 12, a first connecting wire 13, a power plug 14, and a second connecting wire 15. The four pin female port 11 includes a signal end 11. The six pin male port 12 includes a signal connecting end 121 and a power connecting end 122. The first connecting wire 13 is connected with the signal end 111 of the four pin female port 11 and the signal connecting end 121 of the six pin male port 12. Besides, the power plug 14 is a DC (direct current) power plug. The power plug 14 has a power end 141, a male connecting end 142, and a female connecting end 143. The second connecting wire 15 is connected with the power end 141 of the power plug 14 and the power connecting end 122 of the six pin male port 12.

Therefore the IEEE-1394 adapter of the present invention has the functions of converting a mini-type four pin port to be as a standard six pin port and integrating with the power supply.

Figure 2:
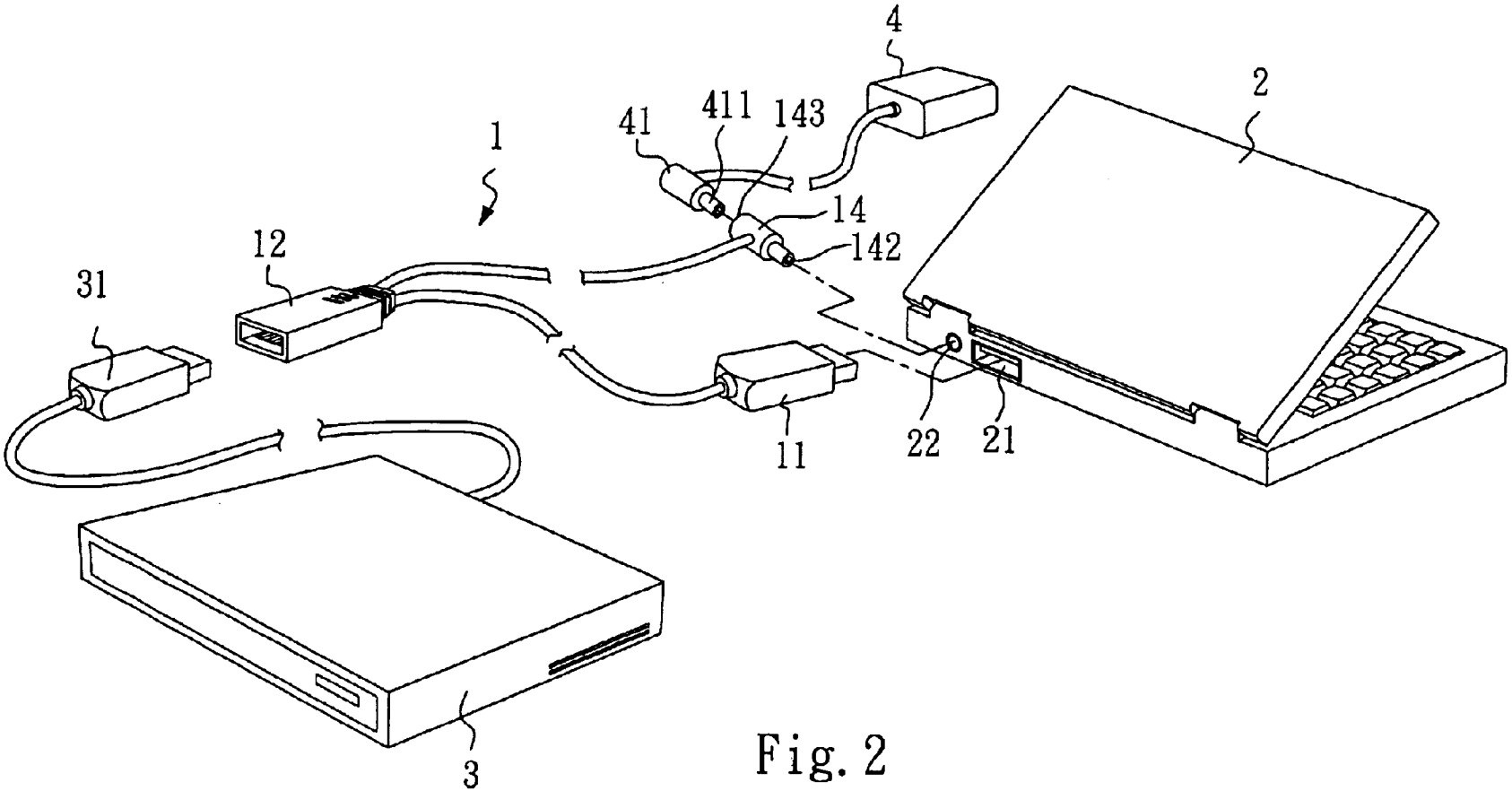
FIG. 2 is an application schematic view of the present invention.

With reference to FIG. 2, a schematic view about the application of the IEEE-1394 adapter 1 of the present invention is illustrated. A portable computing device 2, a computer peripheral device 3, and a power supply 4 are illustrated. The portable computing device 2 is formed with a four pin male port 21 and a power seat 22. The four pin female port 11 of the IEEE-1394 adapter 1 of the present invention is correspondingly connected to the four pin male port 21 of the portable computing device 2 for signal transmission. The male connecting end 142 of the power plug 14 is correspondingly connected to the power seat 22 of the portable computing device 2 for supplying power to the portable computing device 2. Besides, in this the present invention, the computer peripheral device 3 uses an optic disk driver, which includes a six pin female port 31. The six pin male port 12 of the IEEE-1394 adapter 1 is correspondingly connected to the six pin female port 31. Since the six pin female port 31, as a six pin male port 12 of the IEEE-1394 adapter, has a signal connecting end and a power connecting end (not shown), the optic disk driver can transfer signals and power through the IEEE-1394 adapter 1 of the present invention. Besides, the power supply 4 includes a power supply plug 41. The power supply plug 41 includes a power supply male connecting end 411. The female connecting end 143 of the power plug 14 of the IEEE-1394 adapter 1 according to the present invention is correspondingly connected to the power supply male connecting end 411. Thereby, the power supply 4 can transfer power to the portable computing device 2 and computer peripheral device 3 through the IEEE-1394 adapter 1.

Therefore by the function of converting the four pin port to a six pin port and the power supply function, the application is convenient and the peripheral device is expandable.

Figure 3:
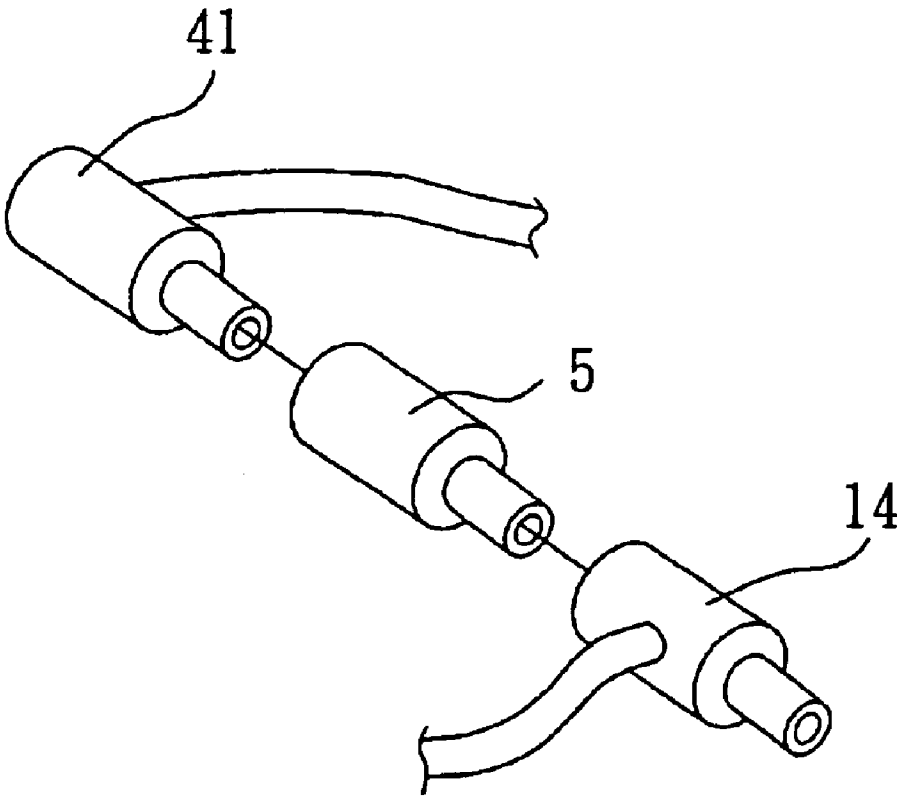
FIG. 3 is a schematic view showing the adaptor is used in the present invention.

Referring to FIGS. 2 and 3, an application schematic view of an adaptor 5 is illustrated in FIG. 3. When the power supply plug 41 of the power supply 4 has different specification, an adaptor 5 is used in adaptation.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An IEEE-1394 adapter comprising:

a four pin female port including a signal end;

a six pin male port including a signal connecting end and a power connecting end;

a first connecting wire connecting said signal end of said four pin female port to said signal connecting end of said six pin male port;

a power plug being a DC power plug and having a power end; said power plug including a male connecting end and a female connecting end; and a second connecting wire for connecting said power end of said power plug to said power connecting end of said six pin male port.

2. The IEEE-1394 adapter as claimed in claim 1, wherein said four pin female port is correspondingly connected to a four pin male port of a portable computing device, and said male connecting end of said power plug is correspondingly connected to a power seat of the portable computing device.

3. The IEEE-1394 adapter as claimed in claim 1, wherein said six pin male port is correspondingly connected to a six pin female port of a computer peripheral device.

4. The IEEE-1394 adapter as claimed in claim 1, wherein said female connecting end of said power plug is correspondingly connected to a power supply male connecting end of a power supply plug of a power supply.

* * * * *